United States Patent [19]

Lingaraju

[11] 4,296,987

[45] Oct. 27, 1981

[54] PRESSURE LOCK TERMINAL

[75] Inventor: Bhartoor Lingaraju, Allentown, Pa.

[73] Assignee: Square D Company, Palatine, Ill.

[21] Appl. No.: 87,369

[22] Filed: Oct. 23, 1979

[51] Int. Cl.[3] ..... H01R 4/26

[52] U.S. Cl. ..... 339/95 D

[58] Field of Search ..... 339/95 D

[56] References Cited

U.S. PATENT DOCUMENTS

| | | | |
|---|---|---|---|
| 3,489,985 | 1/1970 | Martin | 339/95 D |
| 3,543,221 | 11/1970 | Schmier | 339/95 D |
| 4,172,628 | 10/1979 | Lingaraju | 339/95 D |

FOREIGN PATENT DOCUMENTS

| | | | |
|---|---|---|---|
| 1447935 | 9/1976 | United Kingdom | 339/95 D |

*Primary Examiner*—Eugene F. Desmond

*Attorney, Agent, or Firm*—John R. Garrett; Carmen B. Patti; Richard T. Guttman

[57] ABSTRACT

This disclosure depicts a novel improved electrically conductive double action pressure lock terminal assembly for use with an electrical wiring device capable of holding various diameter sized conductors. The pressure lock terminal assembly comprises: an electrically non-conductive base having a cavity stop means; an electrically conductive contact strip supported by the base, the contact strip having a main section with at least one jaw section extending from the end of the main section; and an electrically conductive double action pressure lock attached to and extending at a right angle from the main section such that the double action pressure lock is positioned a predetermined distance beneath the jaw section of the contact strip.

2 Claims, 3 Drawing Figures

PRESSURE LOCK TERMINAL

CROSS REFERENCE TO RELATED APPLICATIONS

This application relates to, but in no way dependent upon, copending application of common ownership herewith Ser. No. 867,541 filed Jan. 6, 1978 (a continuation-in-part application of application Ser. No. 720,281 now abandoned), now U.S. Pat. No. 4,172,628, issued Oct. 30, 1979.

BACKGROUND OF THE INVENTION

This invention relates to the field of pressure lock terminals for electrical receptacles wherein the bared end of a wire conductor is inserted into a recess of the receptacle for electrical connection therewith, and it becomes locked therein until released.

Prior art devices of this type have used various types of cantilevered spring members formed from the conductive bus element of the receptacle to bear against one side of an inserted wire conductor, and an oppositely facing bearing wall or anvil also formed from the conductive bus element to bear against the second opposite side of the inserted wire conductor.

One problem encountered by such prior art devices was skewing of the inserted wire conductor away from the free end of the cantilever spring with resultant loss of electrical contact, creation of a high resistance connection, and weakening or complete loss of the mechanical connection whereby the wire conductor could be accidentally withdrawn entirely from the receptacle leaving a bared end of the conductor exposed.

Another problem encountered by prior art devices is the inability to receive various sized diameter conductors through a plug-in aperture in the back of the receptacle without causing a permanent set to occur in the spring when a relatively large conductor is inserted through the aperture. A permanent set occurs in the spring when a conductor having a large diameter is inserted and the size of the diameter of the conductor causes the spring to deflect beyond its elastic limits thus resulting in a spring which does not return to its original position after the conductor is withdrawn. Existing prior art devices have a single action cantilever spring, and in order to adapt such springs for a wide range of various diameters of conductors, a relatively large lever arm to obtain the magnitude of deflection is needed to accommodate a wide range of conductor diameters without causing a undesirable permanent set to occur.

The novel invention of the above-identified copending application solves the problem of skewing by providing a recess having a continuous bounding wall in which the inserted bared end of the wire conductor seats. The wire conductor is thus held against skewing and is retained in alignment with the free end of the cantilever spring which biases the wire conductor against an oppositely facing anvil or bearing wall which extends longitudinally from the recess having a completely bounding wall to the opening to the exterior surface of the receptacle. The anvil or bearing wall is provided with a concave bearing face throughout its longitudinal extent, to bear against and support a substantial portion of the circumference of the bared wire conductor throughout its full inserted length. Thus, in addition to the fully bounded wall of the seat which positively retains the end of the inserted wire conductor from skewing, the concave surface of the anvil or bounding wall provides a trough which also retains the inserted wire conductor from skewing. To accomplish these objectives the fully bounded seat and the concave anvil wall are formed as depending members of the cover portion of the receptacle.

The novel invention of the above-identified copending application provides a receptacle which is adapted to receive various diameter size conductors by using a double action spring which enables the spring to deflect over a wide range to accommodate differing conductor diameters.

A drawback of the spring disclosed in the above identified copending application is the lack of a high degree of structural strength. It was believed that it was necessary to sacrifice a certain amount of structural strength in order to achieve the novel double action spring mechanism. The present invention surprisingly achieves this double action spring mechanism without a loss of structural strength.

OBJECTS OF THE INVENTION

It is a general object of the present invention to provide for an electrical wiring device an improved electrically conductive double action pressure lock.

It is a more specific object of the present invention to provide a structural strong spring arm which has a double action deflection.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

DESCRIPTION OF THE PREFERRED EMBODIMENT

Figure 1:
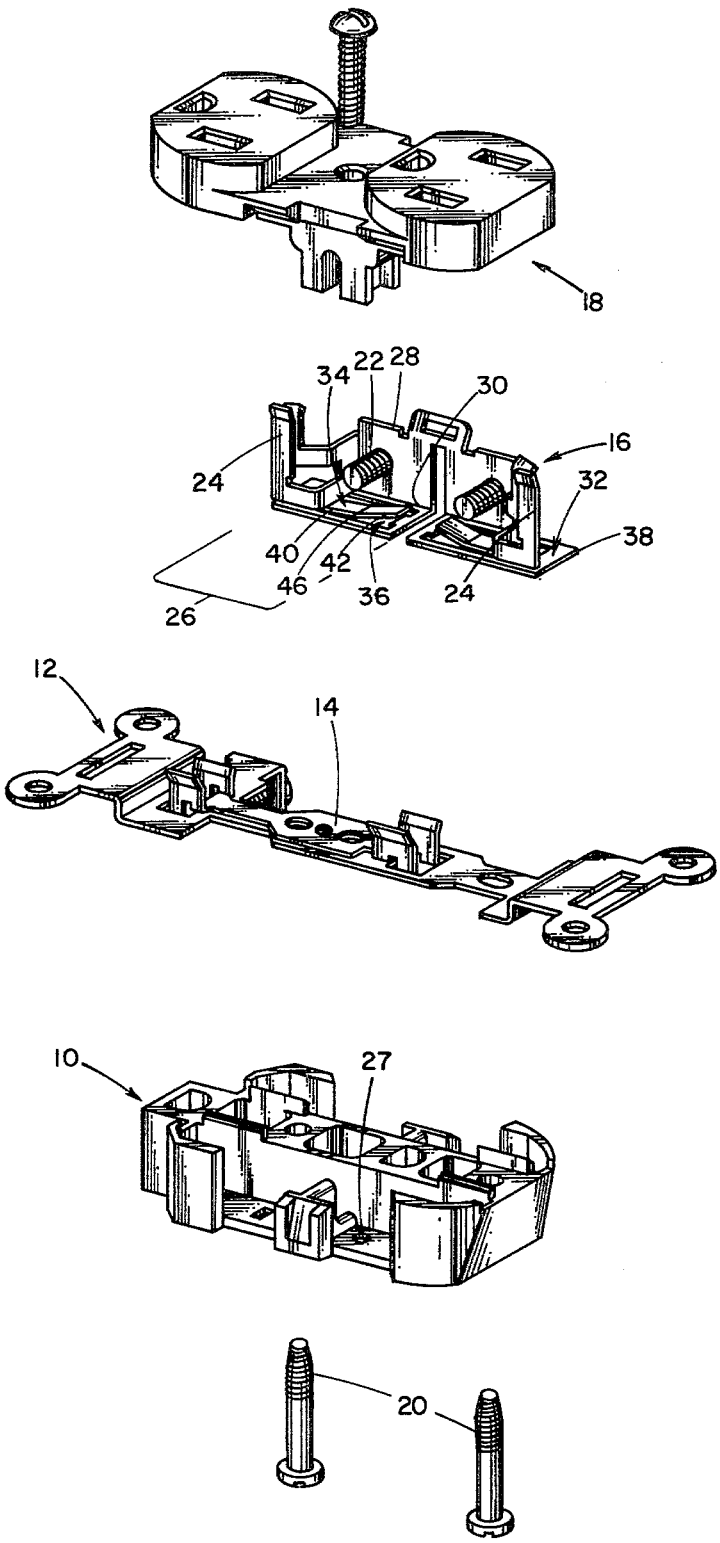
FIG. 1 is an exploded perspective view of an electrical wiring device embodying the present invention.

Whereas the present invention may be embodied in various types of electrical wiring devices, it is preferably embodied in a wiring device of the nature as shown in FIG. 1. In general the wiring device depicted in FIG. 1 has a non-conductive base 10, a metallic ground strip 12, a grounding clip 14, one or more electrically conductive contact strips 16, and a non-conductive cover 18. The electrical wiring device is held together by screws 20 which extend through the base 10, the ground strip 12 and into threaded openings in the cover 18. The contact strip 16 and the ground clip 14 are held in place within the device after the wiring device is assembled.

Terminal screws 22 on contact strip 16 provide one means for attaching electrical wires to the wiring device. The jaws 24 on the contact strips 16 provide a means for making electrical contact with standard electrical plugs which are inserted thru the cover 18. The present invention provides an alternative means of attaching electrical wires to the wiring device. The bared ends of electrical wires may be inserted through apertures 27 in the base 10 and are held mechanically and electrically by an electrically conductive double action pressure lock 26 on the contact strips 16.

The present invention will now be described. The present invention is a novel improved electrically conductive double action pressure lock terminal assembly for use with an electrical wiring device capable of holding various diameter sized conductors. The pressure lock terminal assembly comprises: an electrically non-conductive base; an electrically conductive contact strip supported by the base, the contact strip having a main section with at least one jaw section extending from the end of the main section; an electrically conductive double action pressure lock attached to and extending at a right angle from the main section such that the double action pressure lock is positioned a pre-determined distance beneath the jaw section of the contact strip. The double action pressure lock comprises: a spring support having a first and second end and an elongated interior opening, the spring support being attached to the contact strip along a predetermined portion of a first side of the spring support, and a spring arm having a first and second end, the first end of the spring arm being attached to the first end of the spring support, the spring arm lying within the interior opening of the spring support and the second end being free. The pressure lock terminal assembly also comprises a cavity stop means in the base, the stop means being positioned a predetermined distance beneath the first end of the spring support of the double action pressure lock. When a conductor is inserted in the pressure lock assembly, the conductor contacts the second end of the spring arm, causing the second end of the spring arm to deflect upward and in turn causing the first end of the spring arm and a portion of the spring support near the first end of the spring support to contact the jaw section of the contact strip. Thereafter, as the conductor is inserted further into the pressure lock terminal assembly, the second end of the spring arm continues to deflect upward and the first end of the spring support rotates about the jaw section and eventually contacts the cavity stop in the base. Thereby, the second end of the spring arm deflects a greater amount than the first end of the spring arm, the deflections of the first and second ends of the spring arm resulting in a double action.

Figure 2:
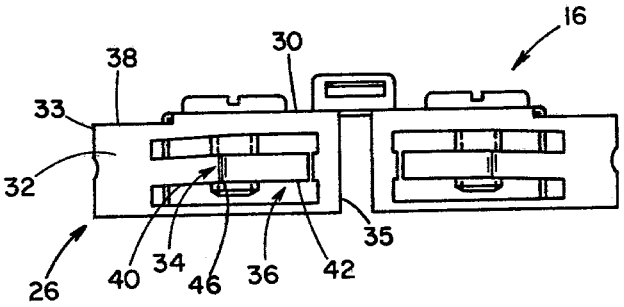
FIG. 2 is a bottom view of the present invention.

A preferred embodiment of the present invention is illustrated in FIGS. 1 and 2. The electrically conductive contact strip 16 which is supported by the base 10 has a main section 28 with at least one jaw section 24. The jaw section 24 extends from the end of the main section 28. The electrically conductive rectangular double action pressure lock 26 is attached to the main section 28 at interface 30. The double action pressure lock 26 is positioned a predetermined distance of approximately 1/32 inches beneath the jaw section 24 and extends at a right angle from the main section 28 of the contact strip 16.

The double action pressure lock 26 comprises a rectangular spring support 32 and a rectangular spring arm 34. The spring support 32 has a first end 33 located substantially beneath the jaw section 24 and a second end 35 and a rectangular interior opening 36 and the spring support 32 is attached to the main section 28 of the contact strip 16 along a distance of approximately two-thirds of a first side 38 of the spring support 32 at interface 30. The spring arm 34 has a first end 40 and a second end 42. The first end 40 of the spring arm 34 is attached to the first end 33 of the spring support 32. The spring arm 34 has a predetermined bend at location 46 and lies within the interior opening 36 of the spring support 32. The second end 42 of the spring arm 34 is free.

The base 10 has a rectangular cavity stop means 48 which is located a predetermined distance of approximately 1/32 inches beneath the first end 33 of the spring support 32 when the contact strip 16 is correctly positioned in the base 10.

Figure 3:
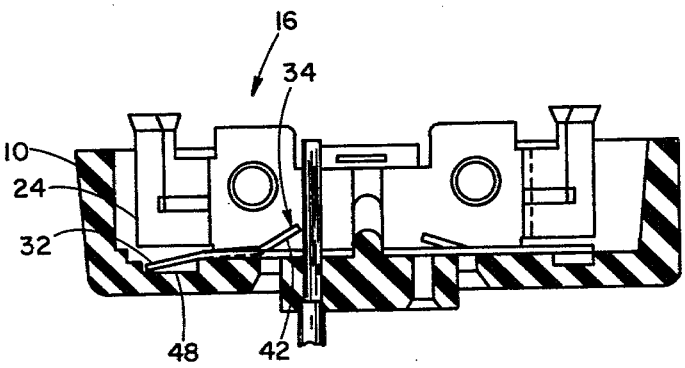
FIG. 3 is a cross-sectional view of the present invention in the electrical wiring device illustrating the double deflection.

The present invention is utilized in an electrical wiring device in the following manner. The bared end of a conductor is inserted through aperture 27 of the base 10 and contacts the pressure lock assembly 26. (See FIG. 3). When the conductor contacts the second end 42 of the spring arm 34 the second end 42 causes the spring arm 34 to deflect upward and in turn causes the first end 40 of the spring arm 34 and a portion of the spring support 32 near the first end 40 of the spring arm 34 to contact the jaw section 24 of the contact strip 16. Thereafter, as the conductor is inserted further into the pressure lock terminal assembly 26 the second end 42 of the spring arm 34 continues to deflect upward and the first end 33 of the spring support 32 rotates downward about the jaw section 24 and eventually contacts the cavity stop means 48 in the base 10. As a result the second free end 42 of the spring arm 34 deflects a greater amount than the first end 40 of the spring arm 34. The deflections of the first end 40 and the second end 42 of the spring arm 34 result in a double action effect.

The present invention can be utilized with a wide range of wire diameters. Each different size wire which is inserted will be held firmly both mechanically and electrically. In the preferred embodiment illustrated wire sizes ranging from #14 to #10 AWG may be used. The novel invention disclosed provides the double action locking affect without sacrificing structural strength. The structural strength is provided by the spring support which defines a continuous closed loop.

The invention is not limited to the particular details of the apparatus depicted and other modifications and applications are contemplated. Certain other changes may be made in the above described apparatus without departing from the true spirit and scope of the invention herein involved. It is intended therefore, that the subject matter in the above depiction shall be interpreted as illustrative and not in a limiting sense.

I claim:

1. An improved electrical conductive double action pressure lock terminal assembly for use with an electrical wiring device capable of holding various diameter sized conductors, said pressure lock terminal assembly comprising:

an electrically non-conductive base;

an electrically conductive contact strip supported by said base, said contact strip having a main section with at least one jaw section extending from the end of said main section;

an electrically conductive double action pressure lock attached to and extending at a right angle from said main section such that said double action pressure lock is positioned a predetermined distance beneath said jaw section of said contact strip, said double action pressure lock comprising;

a spring support having a first and second end and an elongated interior opening, said spring support being attached to said contact strip along a predetermined portion of a first side of said spring support, a spring arm having a first and second end, said first end of said spring arm being attached to said first end of said spring support, said spring arm lying within said interior opening of said spring support, and said second end being free, a cavity stop means in said base, said stop means being positioned a predetermined distance beneath said first end of said spring support of said double action pressure lock;

whereby, when a conductor is inserted in said pressure lock assembly the conductor contacts said second end of said spring arm, causing said second end of said spring arm to deflect upward and in turn causing said first end of said spring arm and a portion of said spring support near said first end of said spring arm to contact said jaw section of said contact strip, thereafter, as the conductor is inserted further into said pressure lock terminal assembly, said second end of said spring arm continues to deflect upward and said first end of said spring support rotates downward about said jaw section and eventually contacts said cavity stop in said base, thereby resulting in said second free end of said spring arm deflecting a greater amount than said first end of said spring arm, said deflections of said first and second ends of said spring arm resulting in a double action.

2. An improved electrically conductive double action pressure lock terminal assembly for use with an electrical wiring device capable of holding various diameter sized conductors, said pressure lock terminal assembly comprising:

an electrically non-conductive base;

an electrically conductive contact strip supported by said base, said contact strip having a main section with at least one jaw section extending from the end of said main section;

an electrically conductive rectangular double action pressure lock attached to and extending at a right angle from said main section such that said double action pressure lock is positioned a predetermined distance beneath said jaw section of said contact strip, said double action pressure lock comprising;

a rectangular spring support having a first and second end and a rectangular interior opening and said spring support being attached to said contact strip along a distance of approximately two-thirds of a first side of said spring support, a rectangular spring arm having a first and second end, said first end of said spring arm being attached to said first end of said spring support, said spring arm having a predetermined bend and lying within said interior opening of said spring support, and said second end being free, a rectangular cavity stop means in said base, said stop means being positioned a predetermined distance beneath said first end of said spring support of said double action pressure lock;

whereby when a conductor is inserted in said pressure lock assembly the conductor contacts said second end of said spring arm causing said second end of said spring arm to deflect upward and in turn causing said first end of said spring arm and a portion of said spring support near said first end of said spring arm to contact said jaw section of said contact strip, thereafter, as the conductor is inserted further into said pressure lock terminal assembly, said second end of said spring arm continues to deflect upward and said first end of said spring support rotates about said jaw section and eventually contacts said cavity stop in said base, thereby resulting in said second free end of said spring arm deflecting a greater amount then said first end of said spring arm, said deflections of said first and second ends of said spring arm resulting in a double action.

* * * * *